US007348782B2

(12) United States Patent
Ando

(10) Patent No.: US 7,348,782 B2
(45) Date of Patent: Mar. 25, 2008

(54) IGNITION DEVICE AND SPARK CONDITION DETECTION METHOD

(75) Inventor: Koji Ando, Motosu (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/406,360

(22) Filed: Apr. 19, 2006

(65) Prior Publication Data

US 2006/0238144 A1 Oct. 26, 2006

(30) Foreign Application Priority Data

Apr. 22, 2005 (JP) ..... 2005-124530

(51) Int. Cl.
*F02P 17/00* (2006.01)
*F02P 3/05* (2006.01)

(52) U.S. Cl. ..... 324/399; 123/644

(58) Field of Classification Search ..... 324/399; 123/644

See application file for complete search history.

(56) References Cited

U.S. PATENT DOCUMENTS 5,322,045 A * 6/1994 Hisaki et al. ..... 123/406.14
5,396,176 A * 3/1995 Ishii et al. ..... 324/388
6,722,343 B2 * 4/2004 Uchida et al. ..... 123/406.33
6,752,122 B2 * 6/2004 Yuya ..... 123/295

FOREIGN PATENT DOCUMENTS

EP 0 810 368 A2 12/1997
JP 11-037900 2/1999

* cited by examiner

*Primary Examiner*—Andrew H. Hirshfeld
*Assistant Examiner*—Amy He

(57) ABSTRACT

When a spark discharge is produced, a first current flows in one direction. From a rise of an ignition signal to energize an ignition coil to a fall of the ignition signal to deenergize the ignition coil, in order that a second current flowing in the opposite direction can be detected, the voltage into which the second current has been converted is compared with a first threshold voltage for smolder detection. After the fall of the ignition signal to the rise of the ignition signal, the voltage into which the second current has been converted is compared with a second threshold voltage for misfire detection. The first threshold is set larger than the second threshold.

9 Claims, 6 Drawing Sheets

FIG. 2A
FIG. 2B
FIG. 2C
FIG. 2D
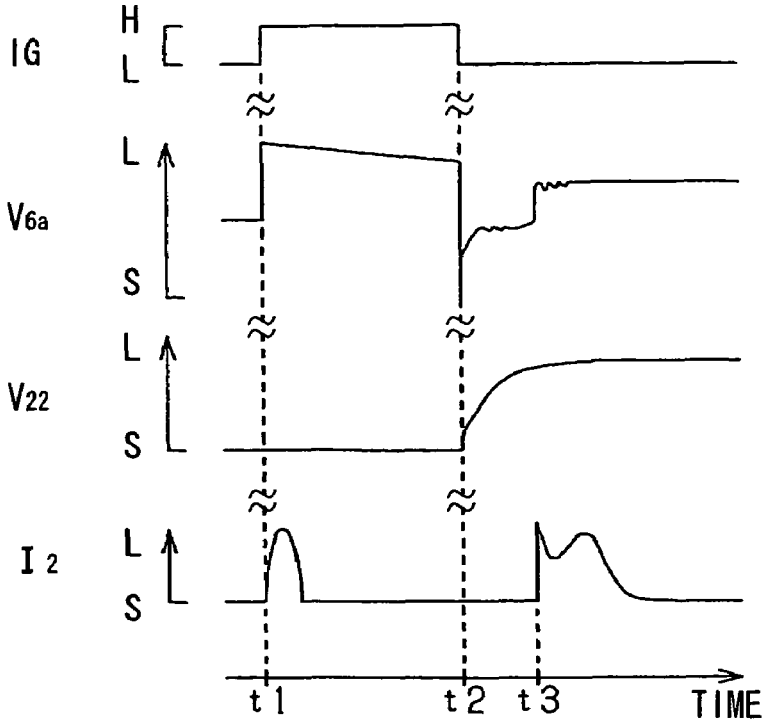
FIG. 4A
FIG. 4B
FIG. 4C
FIG. 4D
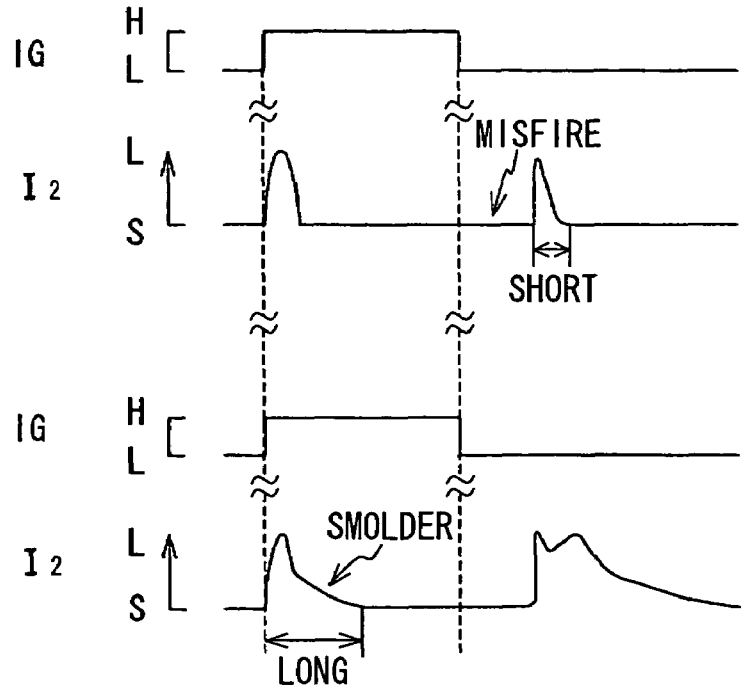

IGNITION DEVICE AND SPARK CONDITION DETECTION METHOD

CROSS REFERENCE TO RELATED APPLICATION

This application is based on and incorporates herein by reference Japanese Patent Application No. 2005-124530 filed on Apr. 22, 2005.

FIELD OF THE INVENTION

The present invention relates to an ignition device and a spark condition detection method that determines a magnitude of a current flowing in reverse to a current, which flows when a voltage generated across a secondary winding of an ignition coil causes an ignition plug to discharge with sparks.

BACKGROUND OF THE INVENTION

EP 0810368 A2 (JP-9-317619 A) discloses an ignition device of this type, which has a capacitor that stores the current flowing in a direction between an ignition plug of an internal combustion engine and the ground when the plug discharges with sparks. After the ignition plug discharges, the capacitor discharges with a current flowing in the opposite direction. The ignition device compares this current with a preset threshold. By taking advantage of the property of the ion current flowing in the foregoing opposite direction through the ions produced when a mixture burns normally in the combustion chamber of the internal combustion engine, the ignition device determines if a misfire has occurred on the basis whether this current is not smaller than the threshold.

Generally, in an internal combustion engine, additives etc. contained in the fuel and/or lubricant may carbonate and stick to the ignition plug, causing the plug to smolder. When the ignition plug smolders, the insulation quality between its electrodes decreases. When an ion current flows, the decrease in insulation quality varies the manner in which the current sensed at a point downstream from the ignition plug flows.

The ignition device detects the smoldering degree from the current flowing after the ion current flows. The threshold is set according to the detected smoldering degree. As a result, even when a smolder occurs, it is possible to properly determine if a misfire has occurred.

When the smoldering degree rises, the internal combustion engine may tend to operate improperly. However, even when the internal combustion engine gets into such a situation, the ignition device merely determines that the situation is a misfire. In the ignition device, in order to implement a function of current detection for grasping the smoldering degree and a function for varying the threshold on the basis of the detected current, the scale of the circuits of the ignition device and the electronic control unit that controls the output from the internal combustion engine increases. The increase cannot be neglected.

SUMMARY OF THE INVENTION

The present invention has an object to provide an ignition device that is simple in structure and that can be operable even if an ignition plug has smoldered and/or misfired.

In general, even when an air-fuel mixture burns in the combustion chamber of an internal combustion engine, the current flowing in the foregoing opposite direction varies between some μA and some hundreds of amperes, depending on the condition and environment in which the internal combustion engine is operating. Accordingly, in order to reliably detect that the mixture has burned, it is necessary to set a second threshold with which a slight current can be detected when it flows. When the thus set second threshold is used, the current flowing in the foregoing opposite direction when the ignition plug smolders slightly is detected. In practice, however, even when the ignition plug smolders, the internal combustion engine can be operated properly until the smolder creates a resistance of some hundreds of MΩ between the electrodes of the plug.

The ignition device uses a first threshold for the detection of a smolder and a second threshold for the detection of the burning condition of a mixture in a combustion chamber. It is possible to properly detect both the burning condition and a smolder by setting the first threshold larger than the second threshold. It is also possible to detect a smolder and the burning condition by means of a simple structure for comparing the current in the opposite direction with the first and second thresholds.

BRIEF DESCRIPTION OF THE DRAWINGS

The above and other objects, features and advantages of the present invention will become more apparent from the following detailed description, In the drawings:

FIGS. 2A to 2D are time charts showing transition of signals in the ignition device;

FIGS. 4A to 4D are time charts of transition showing the transition of signals during a misfire and a smolder.

DETAILED DESCRIPTION OF THE PREFERRED EMBODIMENTS

First Embodiment

Figure 1:
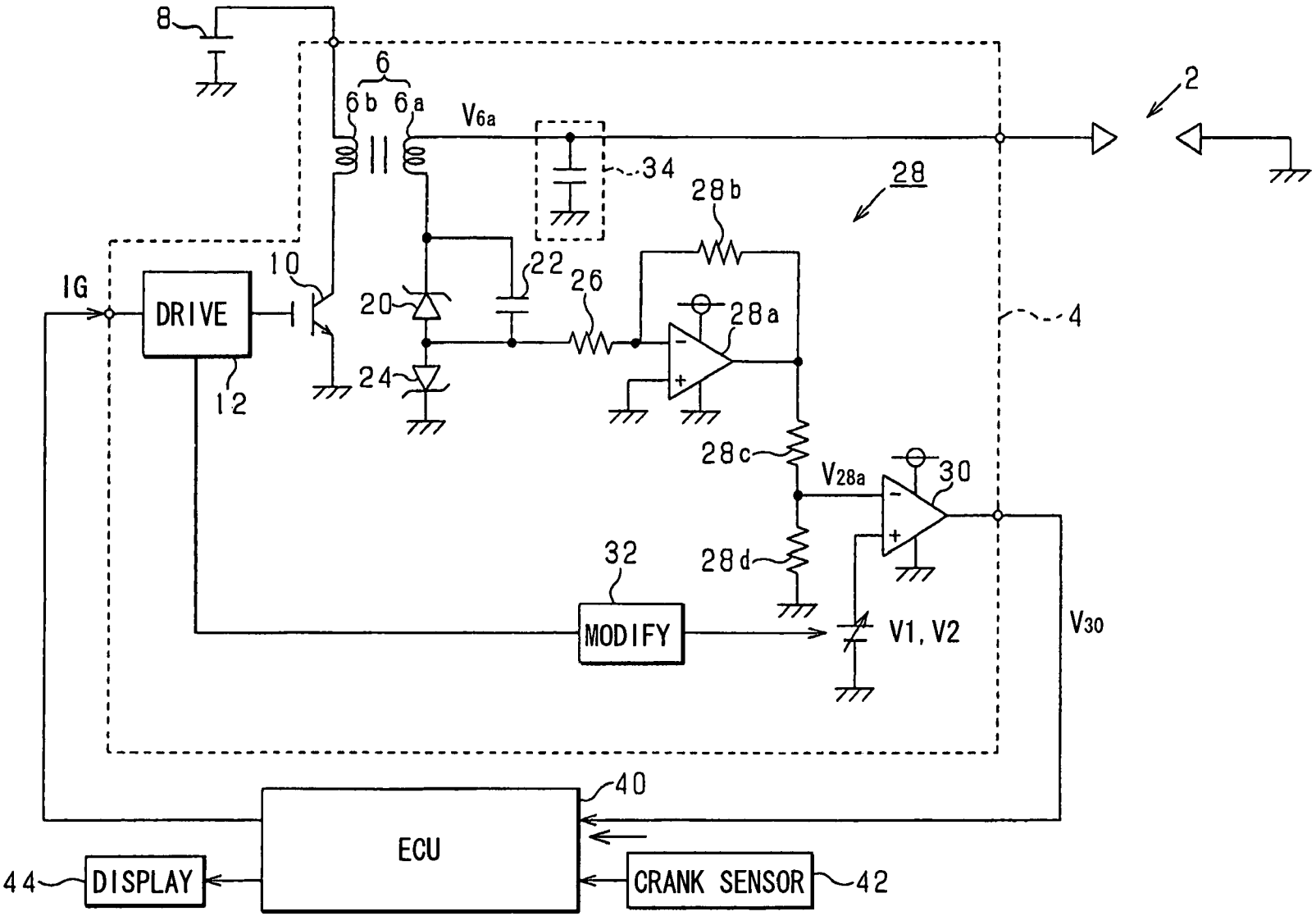
FIG. 1 is a circuit diagram showing a first embodiment of an ignition device.

Referring to FIG. 1, an ignition system includes a spark ignition plug 2 mounted on an internal combustion engine (not shown). One terminal of the ignition plug 2 is grounded, and the other terminal is connected to an ignition device 4. Specifically, the ignition plug 2 is connected to one terminal of the secondary winding 6*a* of an ignition coil 6 in the ignition device 4.

The voltage of a battery 8 outside the ignition device 4 is applied to one terminal of the primary winding 6*b* of the ignition coil 6. The other terminal of the primary winding 6*b* is grounded via a switching transistor 10. The switching transistor 10 is driven by an ignition signal input from outside the ignition device 4. Specifically, a driver 12 shapes the waveform of the ignition signal, and the shaped output from the driver 12 drives the switching transistor 10.

The other terminal of the secondary winding 6*a* is connected to a parallel-connected unit comprised of a Zener diode 20 and a capacitor 22. The parallel-connected unit is grounded via a Zener diode 24. A resistor 26 and a current-voltage converter 28 are connected between the parallel-connected unit and the ground.

The current-voltage converter 28 has a comparator 28*a*. The output from the comparator 28*a* is fed back to the negative terminal of the comparator 28*a* via a resistor 28*b*. The positive input terminal of the comparator 28*a* is grounded. The output from the comparator 28*a* is grounded via a series-connected unit comprised of resistors 28*c* and 28*d*, which divide the output voltage from the comparator 28*a*. The divided voltage is the output voltage from the current-voltage converter 28.

The divided output voltage from the current-voltage converter 28 is input to the negative input terminal of a comparator 30. A preset voltage is applied to the positive input terminal of the comparator 30. The preset voltage is modified by a modifier 32 on the basis of the ignition signal the waveform of which is shaped by the driver 12.

A parasitic capacity 34 shown in the ignition device 4 is formed by the wiring in the device, the insulators adjoining the wiring, and the ground. More precisely, the parasitic capacity 34 includes the capacity component formed by the ignition plug 2, the insulator surrounding the plug, and the ground. For convenience, however, the parasitic capacity 34 is shown between the ignition plug 2 and secondary winding 6*a* of the ignition coil 6.

An electronic control unit (ECU) 40 generates an ignition signal and has a central processing unit and a memory. The sensed values from sensors are input to the ECU 40. The sensors include a crank angle sensor 42 for sensing the rotation position or angle of the crankshaft of the internal combustion engine fitted with the ignition system. The ECU 40 controls the internal combustion engine on the basis of the sensed values. The ECU 40 outputs to a display 44 results of operation based on the sensed values.

In particular, the output signal from the comparator 30 is input to the ECU 40, which determines on the basis of it if a misfire and/or a smolder has occurred in the internal combustion engine.

As shown in FIGS. 2A to 2D, when an ignition signal IG rises at time t1, the voltage V6*a* across the secondary winding 6*b* rises and the primary winding 6*b* is energized during a period of the ignition signal. The voltage rise is such that the terminal of the secondary winding 6*b* that is connected to the ignition plug 2 is high in potential. The voltage rise results in a current being input to the current-voltage converter 28. This current flows because electric charges move when the voltage V6*a* at the terminal of the secondary winding 6*a* that is connected to the ignition plug 2 rises. Specifically, in order to raise the voltage at the terminal of the secondary winding 6*b* that is connected to the ignition plug 2, electric charges move toward the parasitic capacitor 34 that is adjacent to this terminal of the secondary winding 6*b*.

Figure 3A:
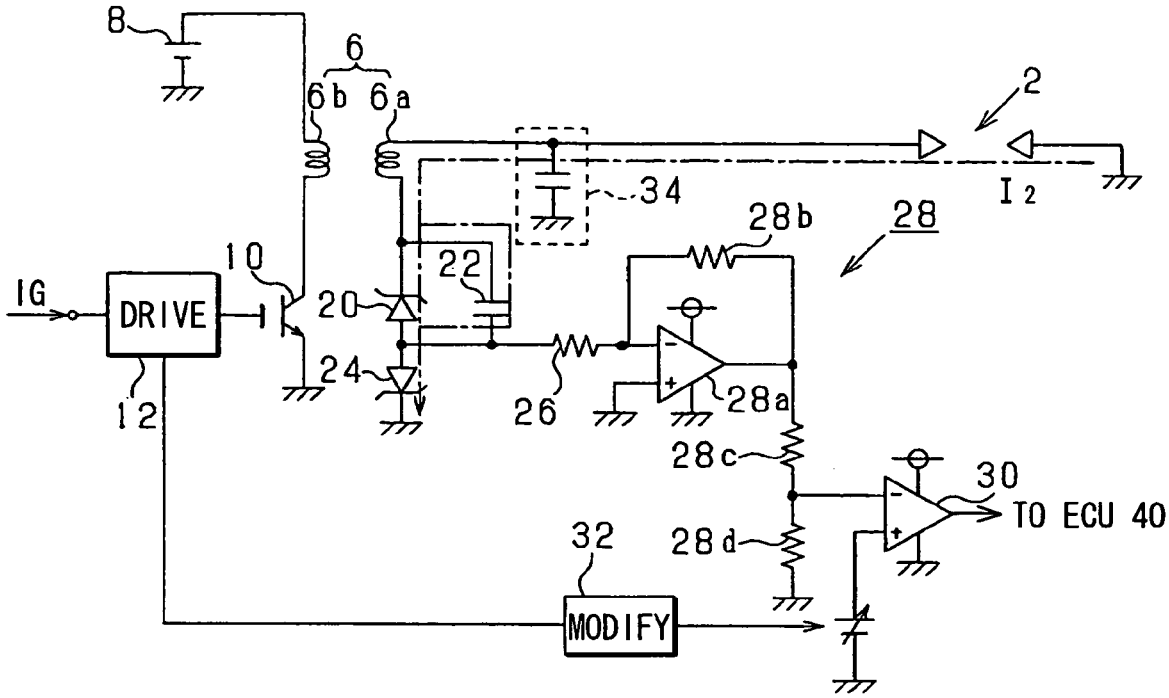
FIGS. 3A and 3B are diagrams showing current paths in the ignition device.

When the ignition signal IG falls at time t2 and the primary winding 6*b* is deenergized, the voltage V6*a* across the secondary winding 6*a* varies greatly. The voltage variation is such that the terminal of the secondary winding 6*a* that is connected to the ignition plug 2 is low in potential. This causes a spark discharge at the ignition plug 2. As indicated by the one-dot chain line in FIG. 3A, the spark discharge results in a current I2 flowing in the direction from the ignition plug 2 toward the ignition coil 6. In FIG. 2D, the current I2 flowing in the direction from the ignition coil 6 toward the ignition plug 2 is positive, and the amount of current smaller than zero is not shown. Accordingly, FIG. 2D does not show the current I2 flowing due to the spark discharge (the amount of current I2 is zero).

Figure 3B:
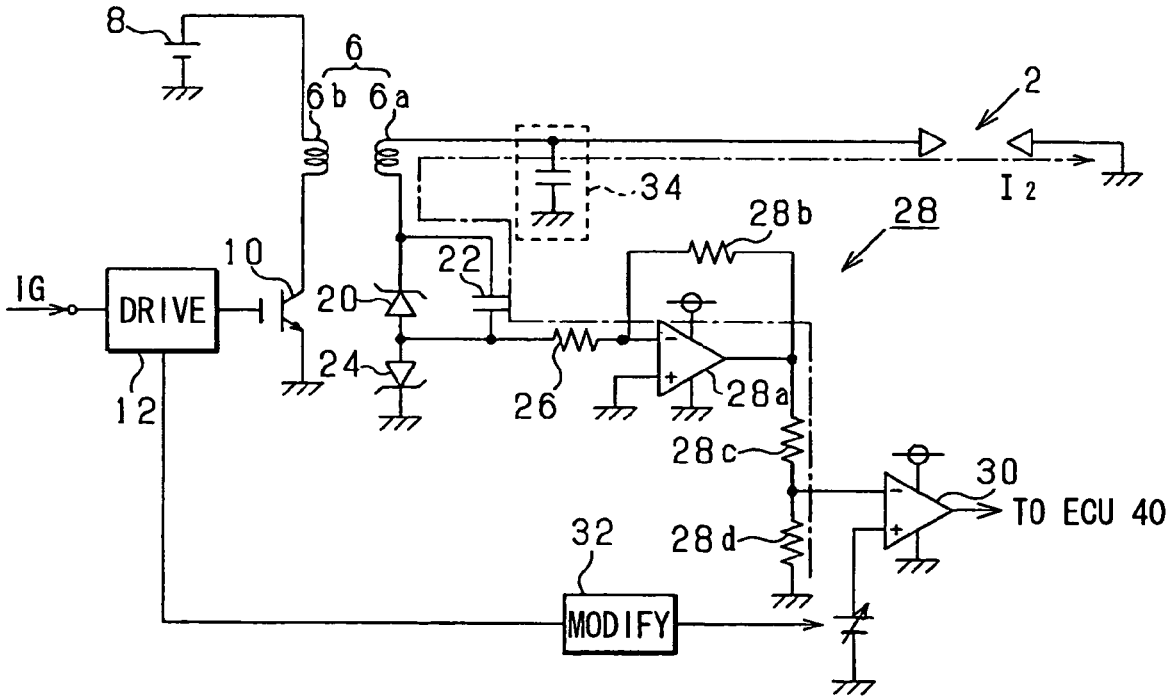

While the spark discharge is occurring, as shown in FIG. 2C, the voltage V22 across the capacitor 22 rises. The voltage rise results in a voltage being applied to the ignition plug 2. This voltage would potentially cause a current I2 to flow in the direction opposite to the direction in which the current I2 resulting from the spark discharge flows. At time t3, a current (ion current) flows through ions between the electrodes of the ignition plug 2. The ions are produced by the combustion of a mixture in the combustion chamber of the internal combustion chamber. As indicated by the one-dot chain line in FIG. 3B, this current I2 flows in the direction from the ignition coil 6 toward the ignition plug 2.

By taking advantage of the foregoing phenomenon, it is possible to detect how a mixture burns in the internal combustion engine. Specifically, while the current input to the current-voltage converter 28 exceeds a preset threshold, the output voltage from the converter 28 exceeds the preset voltage input to the positive terminal of the comparator 30, which then outputs to the ECU 40 a signal (low level) indicating that the output voltage exceeds the preset voltage. The signal output from the comparator 30 varies in length if a misfire and/or a smolder occurs.

When a misfire occurs, the current input I2 to the current-voltage converter 28 changes as shown in FIG. 4B in response to the ignition signal IG shown in FIG. 4A. Thus, when a misfire occurs, the current I2 flowing after an ignition signal falls flows differently than when the combustion is normal. This results in the ignition device 4 outputting a signal different in length than when the combustion is normal. When a smolder occurs, the current input I2 to the current-voltage converter 28 changes as shown in FIG. 4D in response to the ignition signal IG shown in FIG. 4C. As shown in FIG. 4D, the current flowing from the secondary winding 6*a* of the ignition coil 6 to the capacitor 22 tends to flow for a time longer than when no smolder occurs (shown in FIG. 2D). This results in the ignition device 4 outputting a signal different in length than when no smolder occurs.

In this embodiment, the detection of a smolder on the ignition plug 2 is based on the current flowing due to the rise of an ignition signal IG, and the detection of a misfire is based on the current flowing after the ignition signal IG falls.

The signal output from the ignition device 4 is input to the ECU 40, which makes misfire and smolder determinations based on the length of the signal from the device 4. The process performed by the ECU 40 will be described below with reference to FIGS. 5 and 6.

Figure 5:
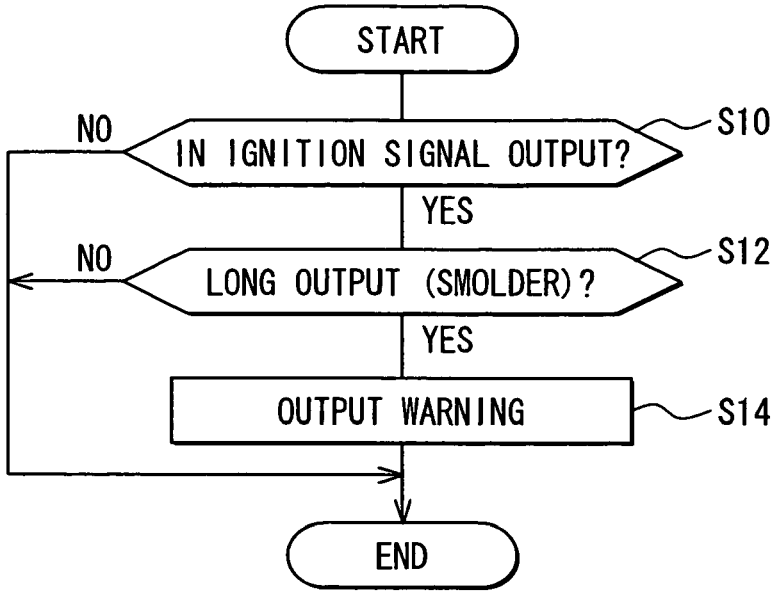
FIG. 5 is a flowchart showing a process for determining if a smolder has occurred.

FIG. 5 shows a process for determining if a smolder has occurred. This process is performed by the ECU 40 and may be repeated in preset cycles.

First, at step S10 of this process, it is determined if an ignition signal is being output. This determination is performed because, in this embodiment, smolder detection is performed while the ignition signal is lasting. When it is determined at step S10 that the ignition signal is being output, then it is determined at step S12 if the output signal from the ignition device 4 is long in length, that is, it is equal to or longer than a first preset period $\alpha$. The period is so set that it can be detected that a smolder increases the current flowing between the electrodes of the ignition plug 2, so that it is expected that the internal combustion engine will not operate properly.

When it is determined that the output signal from the ignition device 4 is equal in length to or longer than the preset period, then at step S14 the ECU 40 outputs to the display 44 warning information that it is likely that a smolder will make the internal combustion engine difficult to operate properly.

When it is determined at step S10 that no ignition signal is being output, or when it is determined at step S12 that the output signal is shorter than the preset period, or when step S14 is completed, the process ends once.

Figure 6:
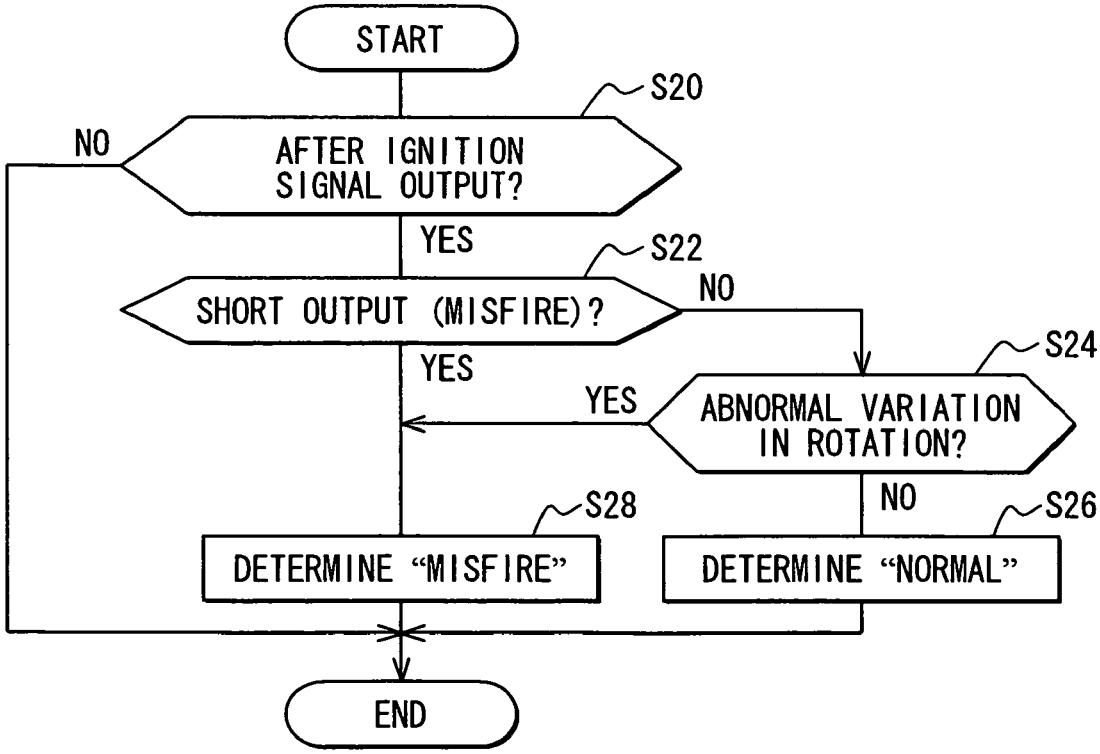
FIG. 6 is a flowchart showing a process for determining if a misfire has occurred.

FIG. 6 shows a process for determining if a misfire has occurred. This process is performed by the ECU 40 and may be repeated in preset cycles.

First, at step S20 of this process, it is determined if a preset period has passed after an ignition signal is output. Specifically, as shown in FIGS. 2A to 2D, because the capacitor 22 starts to discharge at time t3 after time t2 (the ignition signal falls), ion current is detected at time t2. When it is determined at step S20 that the preset period has passed after the ignition signal is output, then step S22 starts.

At step S22, it is determined if the output signal from the ignition device 4 is short in length, that is, it is equal to or shorter than a second preset period β. The second period is so set that it can be determined if an ion current has flowed. Specifically, in comparison with the period during which a current flows after the time t3 indicated in FIG. 2D, the period during which the current flows in FIG. 4B is short. In view of this, the second period is set. When it is determined at step S22 that the output signal is longer than the second preset period then step S24 starts.

At step S24, based on the output from the crank angle sensor 42, it is determined if any variation in the engine speed is abnormal, indicating a misfire. When it is determined at step S24 that the speed variations are normal, then it is determined at step S26 that the combustion is normal.

When it is determined at step S22 that the output signal is equal in length to or shorter than the second preset period, or when it is determined at step S24 that any variation in the engine speed is abnormal, then it is determined at step S28 that a misfire has occurred. When it is determined that a misfire has occurred, the ECU 40 performs suitable processing, such as feedback control of fuel combustion control that involves varying the manipulated variable for the actuator of the internal combustion engine.

When it is determined at step S20 that the preset time has not passed, or when step S26 (normal) or S28 (abnormal) is completed, then the process ends once.

This embodiment makes it possible to determine if the ignition plug 2 has smoldered and/or if the internal combustion engine has misfired.

When a mixture burns in the combustion chamber, an ion current flows. The ion current varies between several μA and several hundred A depending on the condition and environment in which the internal combustion engine is operating. Therefore, in order to reliably detect whether a mixture has burned in the combustion chamber, it is necessary to sense any slight current when the current flows. When it is detected whether a smolder has occurred, it is preferable to consider that, even if a smolder has occurred, the internal combustion engine can be operated properly until the smolder creates a resistance of some hundred MΩ between the electrodes of the ignition plug 2. That is, until the current input to the current-voltage converter 28 due to the smolder increases to some extent, it is preferable not to detect the current. It is preferred to determine occurrence of a smolder when the current is in a range of, for instance, 10 to 50 μA.

Thus, a criterion is required by which a slight ion current can be detected, but it is required that a current resulting from a smolder should not be detected until the current increases to some extent. The detection of an ion current and the detection of a smolder involve inconsistent requirements.

Therefore, in this embodiment, a first threshold and a second threshold are set, with which smolders and misfires can be detected. It can be detected with the first threshold whether the ignition plug 2 has smoldered. It can be detected with the second threshold how a mixture is burning in the combustion chamber of the internal combustion engine, which is fitted with the ignition plug 2. This will be described below in detail.

Figures 7A, 7B, 7C, 7D, 7E:
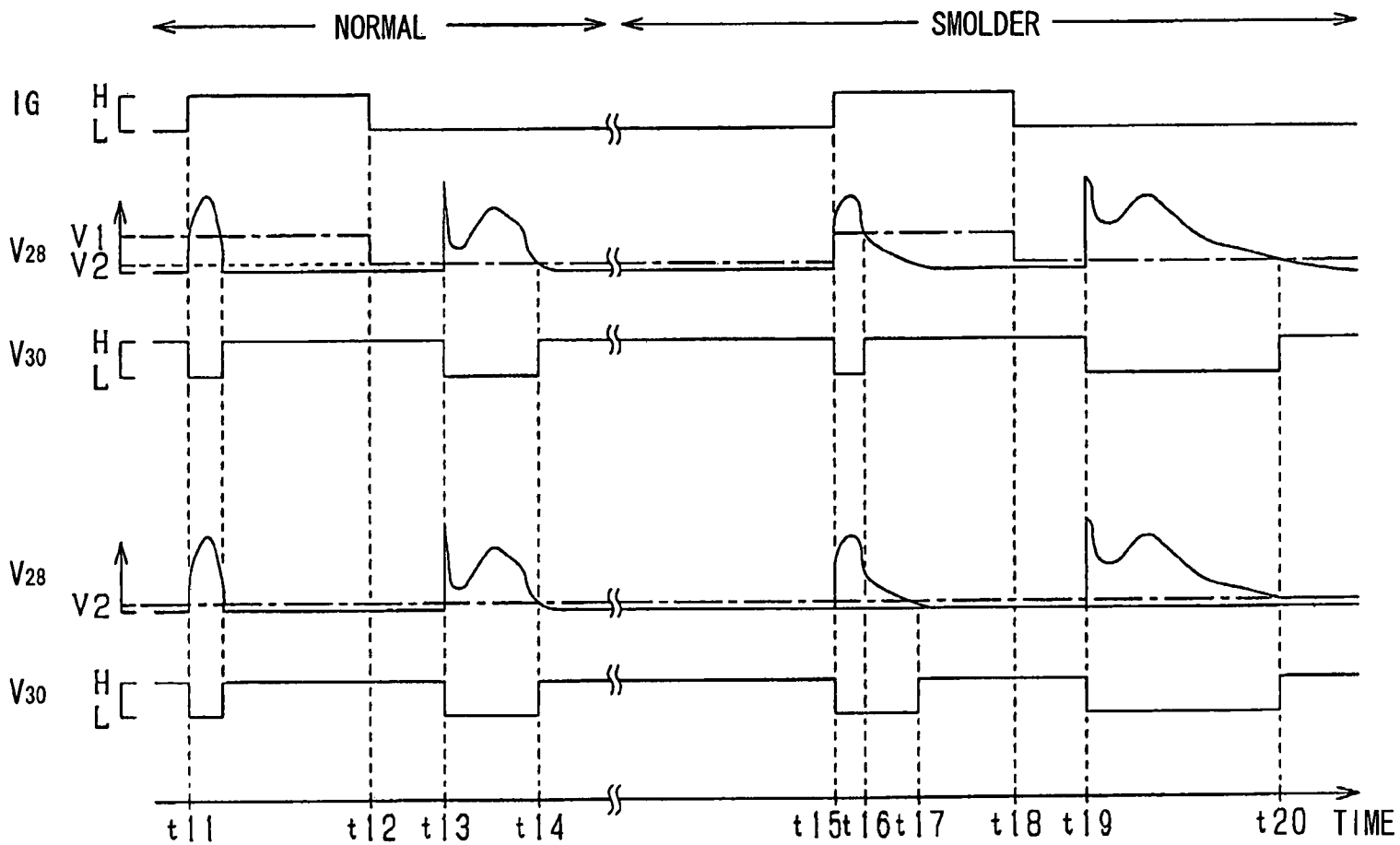
FIGS. 7A to 7E are time charts showing how two thresholds are used in the first embodiment.

FIGS. 7A to 7E show how output signals are generated in the ignition device 4. FIG. 7A shows the transition of the ignition signal IG. FIG. 7B shows the transition of the voltage output V28*a* from the current-voltage converter 28, specifically the converter 28*a*. FIG. 7C shows the transition of the output signal V30 from the ignition device 4, specifically comparator 30.

In FIG. 7B, the one-dot chain lines indicate the preset voltage for comparison with the voltage signal V28*a* output from the current-voltage converter 28. As shown, the preset voltage has two-stage values. One of the two values corresponds to the first threshold, with which it can be detected whether the ignition plug 2 has smoldered. The other value corresponds to the second threshold, with which it can be detected how a mixture is burning in the combustion chamber of the internal combustion engine, which is fitted with the ignition plug 2. The first voltage V1, which corresponds to the first threshold for smolder detection, is used for the periods during which ignition signal IG lasts between time t11 and time t12 and between the time t15 and time t18. The second voltage V2, which corresponds to the second threshold for burning condition detection, is used for the other periods.

The first voltage V1 is higher than the second voltage V2. That is, the first threshold is larger than the second threshold. This setting makes it possible to output a signal indicating that a slight current flowing due to the combustion of a mixture has been detected. This setting also makes it possible to detect a smolder only after it is worried that the internal combustion engine will be difficult to operate properly. The ignition device 4 has the first and second thresholds by storing in the modifier 32 information on the voltages V1 and V2.

By using the voltages V1 and V2, the ignition device 4 can output a signal indicating that an ion current has been detected and a signal indicating that a current resulting from a smolder has been detected. Specifically, the voltage V28 from the current-voltage converter 28 is higher than the voltage V1 or V2, the comparator 30 outputs a logical low level (L) signal. Based on the length of the logical L signal and according to the processes shown in FIGS. 5 and 6, the ECU 40 finally determines if the ignition plug 2 has smoldered and if the internal combustion engine has misfired.

FIGS. 7D and 7E show the same threshold for both smolder detection and burning condition (misfire) detection. As shown, the current flowing due to the rise of the ignition signal IG changes greatly even by a slight smolder. Accordingly, while a smolder is occurring, the output signal V30 is logical L between time t15 and time t16 at FIG. 7C and between time t15 and time t17 at FIG. 7E.

In the process shown in FIG. 5, by lengthening the first preset period for smolder determination, it is possible to dull the sensitivity to the current changes due to slight smolders to a certain degree. However, when the threshold is so set that the ignition device 4 is sensitive to slight currents in order to detect the burning condition with accuracy, the capacitor 22 may start to discharge (at time t19) during a period when the output signal from the device 4 is logical L while a smolder is occurring without preventing proper operation of the internal combustion engine. Accordingly, only by lengthening the first preset period, it is impossible to properly determine if it is likely that a smolder will make the internal combustion engine difficult to operate properly.

It may be conceivable that a smolder can be detected after the capacitor 22 starts to discharge. In this case, however, when a smolder is detected by the variation in the period between time t19 and time t20 with respect to the period between the time t13 and time t14 in FIG. 7E, it is difficult to keep the accuracy of detection high.

The reason for this is that, after the ignition signal IG falls, the output from the current-voltage converter 28 is liable to be influenced by noises because the vicinity of the primary winding 6*b* of the ignition coil 6 is high in impedance, and/or for some other reason. Because the battery 8 is connected to accessory devices and/or auxiliary devices of the internal combustion engine, the voltage of the battery 8 varies with the manner in which current is supplied from the battery 8. This variation varies the voltage in the vicinity of the primary winding 6*b*. The voltage variation in the vicinity of the primary winding 6*b* is greater when the vicinity is high in impedance while the switching transistor 10 is off than when it is low in impedance while the transistor 10 is turned on. The voltage variation in the vicinity of the primary winding 6*b* induces a voltage variation in the vicinity of the secondary winding 6*a*. The voltage variations in the vicinity of the secondary winding 6*a* are not limited to those caused by variations in the voltage of the battery 8, but may be caused by noises made by the interference between cylinders when the internal combustion engine is a multi-cylinder engine and when the ignition coil 6 are common to the cylinders.

By contrast, in this embodiment, smolder detection is performed when the ignition signal IG rises. This makes it possible to perform smolder detection while the influence of noises is inhibited suitably. The first threshold is so set that the capacitor 22 starts to discharge after the termination (rising edge) of a logical L signal output from the ignition device 4 when it is likely that the internal combustion engine will be difficult to operate properly. In this case, the first period is set shorter than the period that starts when an ignition signal rises and that ends when the capacitor 22 starts to discharge.

This embodiment provides the following effects.

(1) The first threshold is set for the detection of smolders. The second threshold is set for the detection of the burning condition of a mixture. By setting the first threshold larger than the second threshold, it is possible to properly perform both smolder detection and burning condition detection.

(2) The period when the first threshold is used is synchronized with the period when an ignition signal keeps the switching transistor 10 turned on. This makes it possible to perform smolder detection properly by taking advantage of a property of the current flowing due to the voltage application to the ignition coil 6, the property being such that the current is varied by the occurrence of a smolder. By performing smolder detection when the switching transistor 10 is turned on, so that the vicinity of the primary winding 6*b* of the ignition coil 6 is low in impedance, it is possible to perform smolder detection while the influence of noises is inhibited suitably.

(3) The determination whether normal combustion is produced in the internal combustion engine is based on the condition that the variation in the engine rotation is normal, in addition to the condition that the output signal from the ignition device 4 is longer than the second preset period. This enables proper smolder determination even when the ignition plug 2 is smoldering slightly.

As stated above, when the second threshold for the detection of the burning condition on the basis of the smoldering degree is variable, the increase in the scale of a circuit for implementing the variable threshold could not be neglected. By contrast, this embodiment makes it possible to properly determine that any misfire has occurred, by using the variation in the engine rotation in addition to the output signal from the ignition device 4, even though the second threshold is set small so that any slight current can be detected.

Second Embodiment

Figures 8A, 8B, 8C:
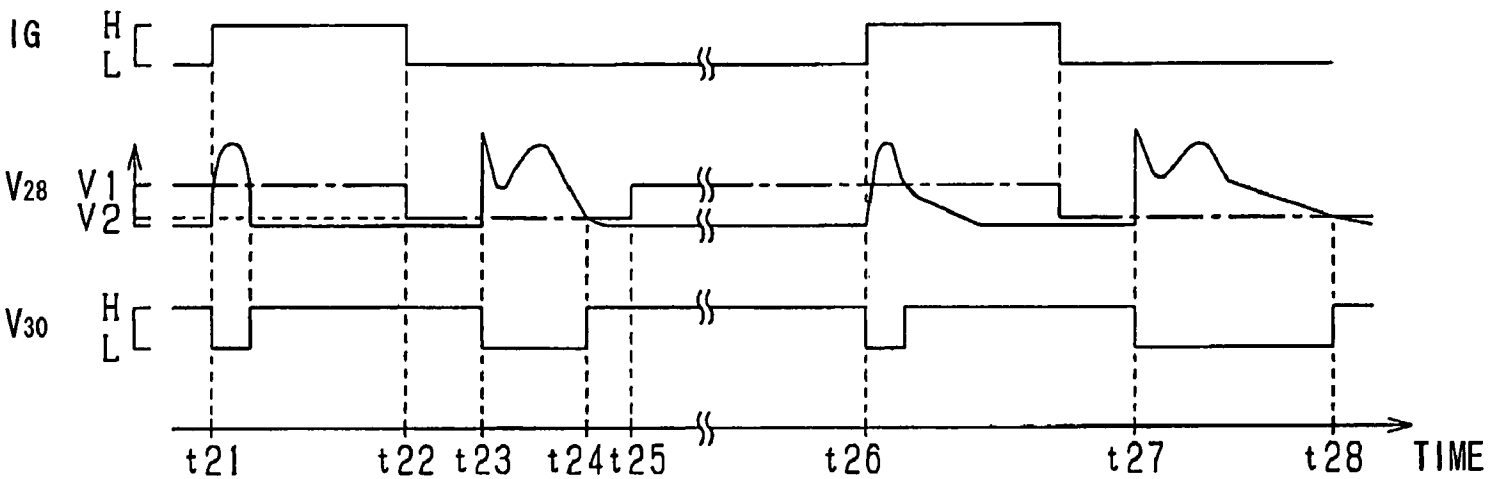
FIGS. 8A to 8C are time charts showing how two thresholds are used in a second embodiment.

In a second embodiment, the second threshold is used during a preset period that starts when the ignition signal IG turns off the switching transistor 10. FIGS. 8A to 8C show how the first and second thresholds are used in this embodiment. FIG. 8A shows the transition of the ignition signal. FIG. 8B shows the transition of the voltage output from the current-voltage converter 28. FIG. 8C shows the transition of the output signal from the ignition device 4.

As shown, the second threshold (which corresponds to the second voltage V2) for the detection of burning conditions is used between time t22 when the ignition signal IG falls and time t25 when the preset period terminates. The preset period is set shorter than the period between the time when the ignition signal IG falls and the time when the next ignition signal IG rises. Accordingly, the first threshold (which corresponds to the first voltage V1) is used at time t21 and time t26 when the ignition signal rises. This enables the ECU 40 to properly determine if smolders have occurred. The second threshold is used when the capacitor 22 discharges. This, on the basis of the output signal between time t23 and time t24 and between time t27 and time t28, enables the ECU 40 to properly determine if misfires have occurred.

The modifier 32 may be fitted with a timer in it for timing the preset period after the ignition signal IG falls. This makes it possible to set the period.

This second embodiment provides the same effects as the first embodiment.

Other Embodiments

The first and second embodiments may be modified as follows.

Without having a current-voltage converter 28 that converts the current flowing from the secondary winding 6*a* of the ignition coil 6 toward the resistor 26 into a voltage and outputs the voltage, the ignition device could bring about effects equivalent to those of the two embodiments when it had a circuit that compares the current with the first and second thresholds.

When the current flowing from the secondary winding 6*a* of the ignition coil 6 toward the resistor 26 is equal to or greater than the first or second threshold, the ignition device 4 outputs a signal, which is not limited to logical L but might be logical H.

The switching between the first and second thresholds is not limited to that illustrated in the two embodiments. The ignition device may be so adjusted that, after the switching transistor 10 is turned off, the second threshold is used when the capacitor 22 discharges.

It is not essential that the ignition device should switch from the first threshold to the second threshold nearly when the switching transistor 10 is turned off. The current flowing when a preset period has passed since the switching transistor 10 is turned off might be compared with each of the two thresholds. The results of the comparison might be output as individual output signals. However, this would involve providing two comparators 30 or otherwise increasing the circuit scale.

Further modifications will be possible without departing from the spirit of the invention.

What is claimed is:

1. An ignition device for producing a spark discharge in an ignition plug of an internal combustion engine, the ignition device comprising:

an ignition coil having a primary winding and a secondary winding for generating a voltage across the secondary winding to generate a spark discharge in the spark plug in response to an ignition signal, the spark discharge causing a current to flow;

a voltage applying means for applying a voltage between the ignition plug and a ground so that a reverse current flows in a reverse direction opposite to that of the current caused by the spark discharge;

a detecting means for detecting the reverse current; and an outputting means for outputting a signal when the reverse current exceeds a preset threshold, wherein the outputting means sets the preset threshold to a first threshold for a detection of a smolder on the ignition plug and to a second threshold for a detection of a burning condition of an air-fuel mixture in the internal combustion engine, the second threshold being smaller than the first threshold.

2. The ignition device of claim 1, wherein:

the ignition signal controls energization and deenergization of the primary winding such that the ignition plug produces the spark discharge by means of the voltage generated across the secondary winding when the primary winding is deenergized after being energized; and the outputting means switches the preset threshold from the first threshold to the second threshold at about time when the primary winding is deenergized from being energized.

3. The ignition device of claim 2, wherein:

the voltage applying means includes a storing means for storing the current caused by the spark discharge; and the outputting means uses the second threshold when the storing means discharges after the primary winding is deenergized.

4. The ignition device of claim 2, wherein:

the outputting means uses the first threshold during the primary winding is energized.

5. The ignition device of claim 2, wherein:

the outputting means uses the second threshold during a preset period after the primary winding is deenergized.

6. The ignition device of claim 2, wherein:

the detecting means converts the reverse current into a voltage signal and outputs the voltage signal to the outputting means; and the outputting means includes a circuit for comparing the voltage signal with the present threshold, and a circuit for changing the preset threshold on the basis of the ignition signal.

7. The ignition device of claim 2, wherein:

the smolder is determined, when the signal output from the outputting means is more than a first preset length during the period when the primary winding is energized.

8. The ignition device of claim 7, wherein:

a misfire is determined, when the signal output from the outputting means is less than a second preset length during a preset period after the primary winding is deenergized.

9. A method for detecting ignition condition of a spark plug in an internal combustion engine, the method comprising:

energizing a primary winding of an ignition coil having a secondary winding connected to the spark plug;

detecting a first current flowing through the spark plug and the secondary winding while the primary winding is energized;

detecting a first period, in which the first current exceeds a first preset level, so that smolder of the spark plug is determined when the first period exceeds a first preset period;

deenergizing the primary winding to generate a spark voltage from the secondary winding so that a spark discharge is generated in the spark plug;

detecting a second current flowing through the spark plug and the secondary winding after the primary winding is deenergized; and detecting a second period, in which the second current exceeds a second preset level different from the first preset level, so that misfire of the spark plug is determined when the second period exceeds a second present period, which is different from the first present period;

wherein the preset first level is larger than the preset second level and set to correspond to about 10 to 50 μA; and the preset first period is set longer than the second preset period.

* * * * *